US005892130A

United States Patent [19]

van Voorst

[11] Patent Number: 5,892,130

[45] Date of Patent: Apr. 6, 1999

[54] OXYALKYLENE-MODIFIED POLYOXYBUTYLENE ALCOHOLS

[75] Inventor: Ronald van Voorst, Vogelwaarde, Netherlands

[73] Assignee: The Dow Chemical Company, Midland, Mich.

[21] Appl. No.: 847,268

[22] Filed: May 1, 1997

[51] Int. Cl.[6] ..... C07C 41/01

[52] U.S. Cl. ..... 568/617; 568/606; 528/409

[58] Field of Search ..... 568/606, 617; 528/409

[56] References Cited

U.S. PATENT DOCUMENTS

| | | | |
|---|---|---|---|
| 2,782,240 | 2/1957 | Hefner et al. | 260/613 |
| 2,819,220 | 1/1958 | Groote et al. | 252/331 |
| 2,888,489 | 5/1959 | Horsley et al. | 260/613 |
| 3,834,935 | 9/1974 | Symm et al. | 117/138.8 B |
| 3,966,625 | 6/1976 | Tanisaki et al. | 252/52 |
| 4,039,466 | 8/1977 | Matsuda et al. | 252/194 |
| 4,191,537 | 3/1980 | Lewis et al. | 44/71 |
| 5,053,154 | 10/1991 | Oppenlaender et al. | 252/51.5 |
| 5,145,948 | 9/1992 | Oppenlaender et al. | 528/409 |

FOREIGN PATENT DOCUMENTS 0 452 988 12/1988 European Pat. Off. .

*Primary Examiner*—Gary Geist
*Assistant Examiner*—Sreeni Padmanabhan

[57] ABSTRACT

Disclosed is an oxyalkylene-modified polyoxybutylene alcohol having an improved viscosity index. Notably enhancement of the viscosity index is obtained when the polyoxybutylene alcohol contains an internal oxypropylene or oxyethylene block; and wherein the total amount of converted butylene oxide in the molecule is from 99 to 75 parts per 100 parts by weight of the total converted alkylene oxide.

14 Claims, No Drawings

OXYALKYLENE-MODIFIED POLYOXYBUTYLENE ALCOHOLS

This invention relates to oxyalkylene-modified adducts of polyoxybutylene alcohols. More specifically this invention relates to high molecular weight polyoxybutylene alcohols modified by incorporating therein an oxypropylene or oxyethylene block.

Polyoxybutylene alcohols are generally prepared by reacting an initiator molecule with butylene oxide in the presence of a catalyst which is typically an alkaline or alkali earth metal substance. The preparation of such adducts is widely reported in the literature, as exemplified by the following publications. U.S. Pat. No. 3,966,625 discloses the preparation of an adduct of butylene oxide with as initiator, methanol, in the presence of an alkaline substance for the purpose of obtaining oil miscible products. U.S. Pat. No. 4,039,466 teaches the reaction of butylene glycol with butylene oxide in the presence of potassium hydroxide as catalyst at a reaction temperature of from 100° C. to 130° C. U.S. Pat. No. 2,819,220 teaches the preparation of an adduct of butylene oxide with an initiator being a polyol in the presence of an alkaline substance at a temperature of from 128° C. to 145° C. U.S. Pat. No. 2,782,240 teaches a reaction process in which butylene oxide is contacted with butanol at a temperature of about 140° C. in the presence of sodium butoxide. U.S. Pat. No. 2,888,489 discloses the preparation of a surface active agent having a polyoxyalkylene chain containing from 5 to 50 alkylene radicals wherein the radical can be a $C_4$ radical obtained by use of butylene oxide. U.S. Pat. No. 4,191,537 teaches the reaction, under alkaline conditions, of butylene oxide with an alkylated phenol in a molar ratio of 25:1. In a recent publication, EP-A-452,988 the preparation of high molecular weight polyoxybutylene adducts is reported wherein at least 20 moles of 1,2-butylene oxide per mole of initiator are reacted in the presence of an alkali substance.

As already noted above, polyoxybutylene alcohols are miscible with oil which makes them a valuable commodity in, for example, the lubricant industry where they can be used as additives to modify the properties of oil-based lubricants. Oil-based lubricants are used in many environments and notably high temperature environments where it is important that they retain an attractive viscosity. At elevated temperatures the viscosity of liquids usually declines and they can more easily flow away from surfaces where they should be present. The relative ease at which liquids flow at elevated temperatures is represented by their viscosity index. A low numerical value to the viscosity index is indicative of substances which at an elevated temperature will have a lower viscosity. To enhance the industrial value of such polyoxybutylene alcohols it would be desirable to provide adducts with an enhanced viscosity index.

From the present investigations, it has been discovered that such enhancement of the viscosity index of polyoxybutylene alcohols can be achieved by incorporating into the molecule a polyoxypropylene or polyoxyethylene block.

SUMMARY OF THE INVENTION

In a first aspect, this invention relates to a process for preparing an oxyalkylene-modified polyoxybutylene alcohol by reacting an initiator with alkylene oxide in the presence of a basic alkaline or alkali earth substance characterized in that the alkylene oxide is 1,2-butylene oxide with propylene oxide or ethylene oxide, wherein the 1,2-butylene oxide is present in an amount of from about 99 to about 75 parts by weight per 100 parts of all alkylene oxide present, and the propylene oxide or ethylene oxide is introduced to the process as a block feed.

In a second aspect, this invention relates to a method of enhancing the viscosity index of a polyoxybutylene alcohol by reacting an initiator with 1,2-butylene oxide in the presence of a basic alkaline or alkali earth substance, the improvement comprising first reacting the initiator with a limited amount of propylene oxide or ethylene oxide prior to reacting with the 1,2-butylene oxide, wherein the amount of propylene oxide or ethylene oxide is in the range of from about 1 to about 25 parts per 100 parts by weight of all oxide to be reacted with the initiator.

In a third aspect, this invention relates to a block-modified oxyalkylene-polyoxybutylene alcohol obtained by reacting an initiator with alkylene oxide in the presence of a basic alkaline or alkali earth substance characterized in that:

a) the alkylene oxide is 1,2-butylene oxide with propylene oxide or ethylene oxide, wherein the 1,2-butylene oxide is present in an amount of from about 99 to about 75 parts by weight per 100 parts of all alkylene oxide present;

b) the propylene oxide or ethylene oxide is introduced to the process as a block feed; and c) the molar ratio of 1,2-butylene oxide to the initiator is at least 5:1.

Such products exhibit a superior viscosity index and have utility in the field of oil-based lubricants.

DETAILED DESCRIPTION

Oxyalkylene-modified polyoxybutylene alcohols having an enhanced viscosity index are obtained according to this invention by reacting 1,2-butylene oxide and a second alkylene oxide with an initiator substance. The second alkylene oxide is ethylene oxide, or preferably propylene oxide.

To obtain the enhancement of the viscosity index of the polyoxybutylene alcohol it has been found that it is necessary to introduce a limited amount of propylene oxide or ethylene oxide as a block feed during the manufacturing process. Advantageously the propylene oxide or ethylene oxide is introduced in its entirety as a single block in the process, and yet more advantageously as a block at the onset of the manufacturing process and prior to any introduction of the 1,2-butylene oxide. If the additional oxide is not introduced as a block, but mixed with the 1,2-butylene oxide and allowed to react and become randomly distributed throughout the oxyalkylene backbone of the polyoxybutylene alcohol then the enhancement of viscosity index may not be achieved.

The amount of 1,2-butylene oxide present is from about 99 to about 75, preferably from about 98 to about 90 parts by weight per 100 parts of all alkylene oxide present including the butylene oxide and propylene or ethylene oxide. In a preferred embodiment of this invention the polyoxybutylene alcohol is obtained from an initiator reacted with alkylene oxide that consists of 1,2-butylene oxide and propylene oxide present in a parts by weight ratio of from about 98:2 to about 90:10, and more preferably in a ratio of from 97:3 to about 94:6. In a lesser preferred embodiment, the polyoxybutylene alcohol is obtained from an initiator reacted with alkylene oxide that consists of 1,2-butylene oxide and ethylene oxide present in a parts by weight ratio of from about 98:2 to about 90:10, and more preferably in a ratio of from about 97:3 to about 94:6. To provide products of industrial value advantageously the molar ratio of butylene oxide to initiator is at least 5:1, preferably 10:1, more preferably 15:1, and yet more preferably at least 25:1. Products of particular utility are obtained when the molar ratio of butylene oxide to initiator advantageously is within the range of from about 15:1 to about 500:1, preferably from about 25:1 to about 300:1, and more preferably from about 25:1 to about 100:1.

The initiator substance for the polyoxybutylene alcohols of this invention can be any substance having a single active hydrogen, such substances include carboxylic acids, thiols, secondary amines and primary or secondary alcohols of aliphatic or aromatic nature. Preferred are the aliphatic alcohols and especially primary or secondary alkyl alcohols where the alkyl radical contains from 1 to 36, preferably from 4 to 24, and more preferably from 4 to 12 carbon atoms. Suitable initiators include those as exemplified by methanol, ethanol, propanol, butanol, hexanol, octanol, decanol, dodecanol, tridecanol, lauryl alcohol, cetyl alcohol, stearyl alcohol, and the like.

As mentioned the process of the invention is operated in the presence of an alkaline or alkaline earth substance having a basic characteristic and generally recognized for its ability to catalyze the reaction of initiator with alkylene oxide. Suitable catalysts include those as exemplified by the hydroxides of, for example, sodium, potassium, rubidium, cesium, calcium, strontium, or barium; also suitable are the lower alkyl and aryl alkoxides of the mentioned metals. By the term "lower" it is meant a substance containing from 1 to 6 carbon atoms. The process advantageously is operated at a temperature of from about 70° C. to about 160° C., preferably from about 100° C. to about 150° C., and more preferably from about 120° C. to about 150° C.

The polyoxybutylene alcohols obtained according to the process disclosed herein have utility as lubricants or lubricant additives in combination with mineral or organic oils where their high viscosity index, attractive thermal stability and general oil miscibility is an advantage.

The following examples are presented to illustrate the invention. All amounts, unless otherwise stated, are as parts by weight. Where reported, the hydroxyl number is observed according to procedure ASTM E326-90, the viscosity according to procedure ASTM D445-94 and D446-93, and the viscosity index according to procedure ASTM D2270-86.

EXAMPLE 1

A oxypropylene-modified polyoxybutylene alcohol containing a total of 26 moles of butylene oxide/mole of initiator with 1,2-butylene oxide and propylene oxide in a parts by weight ratio of 97:3 is prepared according to the following procedure. The propylene oxide is introduced as a block feed prior to introduction of the 1,2-butylene oxide.

To 8.8 parts by weight of dodecanol in a reactor is charged 0.1 parts of potassium hydroxide and the mixture brought to a temperature of 145° C. To this resulting mixture, essentially free of any water content, is then added 2.7 parts of propylene oxide over a period of about 3 hours and subsequently allowed to react out until an essentially constant pressure in the reactor is observed, in this instance about 2 hours. Subsequently 88.4 parts of 1,2-butylene oxide is gradually introduced. On completion of the butylene oxide feed, the total mixture is maintained at 145° C. to allow the reaction to come to completion as observed by an essentially constant reactor pressure.

Laboratory analysis of the resulting product determined a

Hydroxyl Number: 30 mg KOH/g.

Kinetic Viscosity (40° C.): 159.5 cST

Viscosity Index: 167

EXAMPLE 2

An oxypropylene-modified polyoxybutylene alcohol containing a total of 26 moles of butylene oxide/mole of initiator with 1,2-butylene oxide and propylene oxide in a parts by weight ratio of 94:6 is prepared according to the following procedure. The propylene oxide is introduced as a block feed prior to introduction of the 1,2-butylene oxide.

To 8.5 parts by weight of dodecanol in a reactor is charged 0.1 parts of potassium hydroxide and the mixture brought to a temperature of 145° C. To this resulting, essentially free of any water content, mixture is then added 5.3 parts of propylene oxide over a period of about 4 hours and subsequently allowed to react out until an essentially constant pressure in the reactor is observed, in this instance about 2 hours. Subsequently 86 parts of 1,2-butylene oxide is gradually introduced. On completion of the butylene oxide feed, the total mixture is maintained at 145° C. to allow the reaction to come to completion as observed by an essentially constant reactor pressure.

Laboratory analysis of the resulting product determined a

Hydroxyl Number: 27.7 mg KOH/g

Kinetic Viscosity (40° C.): 170.5 cSt

Viscosity Index: 169

COMPARATIVE EXAMPLE A

Mixed Oxide/Random Distribution

A comparative oxypropylene-modified polyoxybutylene alcohol is prepared from the same reactants and proportions and general conditions as for Example 1. However the 1-2-butylene oxide and propylene oxide are introduced as a mixed feed stream.

Laboratory analysis of the resulting product determined a

Hydroxyl Number: 33.0 mg KOH/g

Kinetic Viscosity (40° C.): 144.5 cSt

Viscosity Index: 161

The determined viscosity index of the comparative product is significantly lower than the modified polyoxybutylene alcohol of the invention.

COMPARATIVE EXAMPLE B

Homopolymer—no second alkylene oxide

By way of comparison, a non-modified polyoxybutylene alcohol obtained by reacting in the presence of potassium hydroxide (at 1000 ppm) one mole of dodecanol with 26 moles of butylene oxide at a temperature of 145° C. The obtained product is observed to have a Hydroxyl Number: 34.0 mg KOH/g Kinetic Viscosity (40° C.): 140.7 cSt Viscosity Index: 155.

The results clearly demonstrate the ability to obtain polyoxybutylene alcohols having a superior Viscosity Index by incorporating therein an oxypropylene block.

What is claimed is:

1. A process for preparing an oxyalkylene-modified polyoxybutylene alcohol by reacting an initiator with alkylene oxide in the presence of a basic alkaline or alkali earth substance characterized in that the alkylene oxide is 1,2-butylene oxide with propylene oxide or ethylene oxide, wherein the 1,2-butylene oxide is present in an amount of from about 99 to about 75 parts by weight per 100 parts of all alkylene oxide present, the propylene oxide or ethylene oxide is introduced to the process as a block feed and the propylene oxide or ethylene oxide is introduced to the process and allowed to react out prior to introduction of the 1,2-butylene oxide.

2. The process of claim 1 wherein the mole ratio of butylene oxide to initiator is at least 5:1.

3. The process of claim 1 wherein the alkylene oxide consists of 1,2-butylene oxide and propylene oxide.

4. The process of claim 3 wherein the 1,2-butylene oxide and propylene oxide are present in a parts by weight ratio of from about 98:2 to about 90:10.

5. The process of claim 1 wherein the alkylene oxide consists of 1,2-butylene oxide and ethylene oxide.

6. The process of claim 5 wherein the 1,2-butylene oxide and ethylene oxide are present in a parts by weight ratio of from about 98:2 to about 90:10.

7. The process of claim 1 wherein the initiator is a primary or secondary alkyl alcohol where the alkyl radical contains from 1 to 36 carbon atoms.

8. The process of claim 7 wherein the alkyl radical of the initiators contains from 4 to 24 carbon atoms.

9. The process of claim 8 wherein the mole ratio of alkylene oxide to initiator is at least 25:1, and wherein the alkylene oxide consists of 1,2-butylene oxide and propylene oxide present in a parts by weight ratio of from about 98:2 to about 90:10.

10. The process of claim 9 wherein the propylene oxide is introduced to the process and allowed to react out prior to introduction of the 1,2-butylene oxide.

11. A method of enhancing the viscosity index of a polyoxybutylene alcohol by reacting an initiator with 1,2-butylene oxide in the presence of a basic alkaline or alkali earth substance, the improvement comprising first reacting the initiator with a limited amount of propylene oxide or ethylene oxide prior to reacting with the 1,2-butylene oxide, wherein the amount of propylene oxide or ethylene oxide is in the range of from about 1 to about 25 parts per 100 parts by weight of all oxide to be reacted with the initiator.

12. The method of claim 11 wherein the improvement consists of the use of propylene oxide.

13. The method of claim 12 wherein the amount of propylene oxide is from about 2 to about 10 parts per 100 parts by weight of all oxide to be reacted with the initiator.

14. A block-modified oxyalkylene polyoxybutylene alcohol obtained by reacting an initiator with alkylene oxide characterized in that:

a) the alkylene oxide is 1,2-butylene oxide with propylene oxide or ethylene oxide, wherein the 1,2-butylene oxide is present in an amount of from about 99 to about 75 parts by weight per 100 parts of all alkylene oxide present;

b) the propylene oxide or ethylene oxide is introduced to the process as a block feed and present in the product as an oxypropylene or oxyethylene block; and c) the molar ratio of 1,2-butylene oxide to the initiator is at least 5:1.

* * * * *